US010690022B2

(12) United States Patent
Hoglund et al.

(10) Patent No.: US 10,690,022 B2
(45) Date of Patent: Jun. 23, 2020

(54) PNEUMATIC ACTUATOR FOR AN ENGINE VALVE

(71) Applicant: FREEVALVE AB, Angelholm (SE)

(72) Inventors: Anders Hoglund, Munka Ljungby (SE); Urban Carlson, Helsingborg (SE)

(73) Assignee: FREEVALVE AB, Angelholm (SE)

( * ) Notice: Subject to any disclaimer, the term of this patent is extended or adjusted under 35 U.S.C. 154(b) by 94 days.

(21) Appl. No.: 15/567,035

(22) PCT Filed: Apr. 15, 2016

(86) PCT No.: PCT/SE2016/050327
§ 371 (c)(1),
(2) Date: Oct. 16, 2017

(87) PCT Pub. No.: WO2016/167716
PCT Pub. Date: Oct. 20, 2016

(65) Prior Publication Data

US 2018/0100413 A1 Apr. 12, 2018

(30) Foreign Application Priority Data

Apr. 16, 2015 (SE) ..... 1550460

(51) Int. Cl.
*F01L 9/02* (2006.01)
*F01L 1/053* (2006.01)
(Continued)

(52) U.S. Cl.
CPC ..... *F01L 9/026* (2013.01); *F01L 1/053* (2013.01); *F01L 9/02* (2013.01); *F01L 9/025* (2013.01);
(Continued)

(58) Field of Classification Search
CPC ..... F01L 9/02; F01L 13/06; F01L 13/0005; F01L 1/08; F01L 1/267; F01L 13/085;
(Continued)

(56) References Cited

U.S. PATENT DOCUMENTS 4,075,850 A * 2/1978 Nakazato ..... B25C 1/08 173/200
5,193,495 A 3/1993 Wood, III
(Continued)

FOREIGN PATENT DOCUMENTS

DE 10 2013 011 340 A1 1/2015
WO 2004/092550 A1 10/2004
(Continued)

OTHER PUBLICATIONS

International Search Report issued in Application No. PCT/SE2016/050327, dated Aug. 5, 2016.

*Primary Examiner* — Patrick Hamo
*Assistant Examiner* — Wesley G Harris
(74) *Attorney, Agent, or Firm* — Young & Thompson

(57) ABSTRACT

Disclosed is an actuator for axial displacement of an object, including a cylinder volume having a first portion, and an actuator piston disc displaceable in the axial direction in the cylinder volume between inactive and active positions, an inlet channel between a pressure fluid inlet and the first portion of the cylinder volume, a first inlet valve body in the inlet channel, an outlet channel between the first portion of the cylinder volume and a pressure fluid outlet, and an outlet valve body in the outlet channel. The slave piston is displaceable in a bore, the slave piston displacing the first inlet valve body to an active position, and interacting with an opening connecting the bore and a control pressure channel, the opening having a first flow area with the slave piston in
(Continued)

its inactive position and a larger second flow area with the slave piston in its active position.

14 Claims, 3 Drawing Sheets

(51) Int. Cl.
*F01L 13/06* (2006.01)
*F01L 13/08* (2006.01)
*F01L 1/344* (2006.01)

(52) U.S. Cl.
CPC ..... *F01L 13/06* (2013.01); *F01L 13/085* (2013.01); *F01L 2001/34446* (2013.01)

(58) Field of Classification Search
CPC . F01L 1/053; F01L 1/185; F01L 2001/34446; F01L 2820/01; F01L 9/025; F01L 2105/00; F01L 9/026; F01L 1/465
USPC ..... 123/90.14
See application file for complete search history.

(56) References Cited

U.S. PATENT DOCUMENTS

| | | | | |
|---|---|---|---|---|
| 8,973,541 | B2 | 3/2015 | Hedman | |
| 9,964,006 | B2 * | 5/2018 | Hoglund | F01L 9/02 |

FOREIGN PATENT DOCUMENTS

| | | | | |
|---|---|---|---|---|
| WO | 2013/058704 | A1 | 4/2013 | |
| WO | 2014/007727 | A1 | 1/2014 | |
| WO | 2014/158087 | A1 | 10/2014 | |
| WO | 2015/005856 | A1 | 1/2015 | |
| WO | WO-2016167715 | A1 * | 10/2016 | F01L 9/026 |
| WO | WO-2016167716 | A1 * | 10/2016 | F01L 9/026 |

* cited by examiner

PNEUMATIC ACTUATOR FOR AN ENGINE VALVE

TECHNICAL FIELD OF THE INVENTION

The present invention relates to an actuator for axial displacement of an object. The present invention is specifically useful in applications having high demands for high speeds and precise controllability of the axial displaceability, and low operational noise. The present invention relates specifically to a gas exchange valve actuator for internal combustion engines, in which the actuator is suggested to be used for driving one or more inlet valves or outlet valve controlling the supply and evacuation, respectively, of air relative to the cylinders of the internal combustion engine. Thus, the inventive actuator is especially suitable for driving engine valves and thereby eliminates the need for one or more cam shafts in the internal combustion engine.

The inventive actuator comprises an actuator piston disc and a cylinder volume, the actuator piston disc separating said cylinder volume in a first portion and a second portion and is in axial direction displaceable back and forth in said cylinder volume between an inactive position and an active position. The actuator further comprises an inlet channel extending between a pressure fluid inlet and the first portion of the cylinder volume, a first inlet valve body arranged in said inlet channel, an outlet channel extending between the first portion of the cylinder volume and a pressure fluid outlet, and an outlet valve body arranged in said outlet channel.

BACKGROUND OF THE INVENTION AND PRIOR ART

Thus, an actuator, commonly known as a pneumatic actuator, comprises an actuator piston disc that is displaceable in axial direction between a first position (inactive position) and a second position (active/extended position). The displacement is achieved by controlling a supply of pressure fluid, such as pressurized gas/air, that acts on and drives the actuator piston disc. The actuator piston disc acts in its turn directly or indirectly on the object that is to be displaced, for example an engine valve, for controlling its position.

In the application having an engine valve, when the actuator piston disc is in the inactive position the engine valve is in contact with its seat, and when the actuator piston disc is in the active position the engine valve is open, i.e. located at a distance from its seat.

It is a known demand that the actuators shall have as low operational noise as possible, especially in engine applications, but it is however also known that actuator makes noise during operation. The operational noise is above all generated due to the fact that actuators comprises metal members moving at high velocities and in their respective end positions contact other metal surfaces, whereupon knocking noise is generated. One of the moving metal members is for instance constituted by a slide valve body that in one and the same body comprises a first inlet valve as well as an outlet valve and a hydraulic valve, as is described and disclosed in U.S. Pat. No. 8,973,541. This design entails that the slide valve body, in this connection, has a very large mass entailing a high noise when the slide valve body hits a stop surface in connection with the slide valve body takes it inactive position.

OBJECT OF THE INVENTION

The present invention aims at obviating the above-mentioned drawbacks and shortcomings of previously known actuators for axial displacement of an object and to provide an improved actuator. A basic object of the invention is to provide an improved actuator of the initially defined type that has reduced operational noise.

Another object of the present invention is to provide an actuator that has substantially reduced change over time from closed to fully open inlet channel.

Another object of the present invention is to provide an actuator that entirely eliminates leakage of pressure fluid when the actuator is in the inactive state.

BRIEF DESCRIPTION OF THE INVENTION

According to the invention at least the basic object is achieved by way of initially defined actuator, which has the features defined in the independent claim. Preferred embodiments of the present invention are further defined in the dependent claims.

According to a first aspect of the present invention an actuator of the initially defined type is provided, which is characterized in that the actuator comprises a slave piston that is displaceable back and forth in a bore between an inactive position and an active position, the slave piston being configured to during its movement from the inactive position to the active position displace said first inlet valve body to an active position at which the inlet channel is open, the slave piston interacting with an opening that connects the bore and a control pressure channel, said opening having a first flow area (A1) when the slave piston is located in its inactive position and a second flow area (A2) when the slave piston is located in its active position, wherein said second flow area (A2) is greater than said first flow area (A1).

Thus, the present invention is based on the insight that high operational noise will be generated when the slide valve body of previously known actuators hits a stop surface in connection with reaching the inactive position. According to known technology the velocity of the slide valve body is at highest at the moment of impact. However, said stop surface is necessary in order to obtain a well defined inactive position for the slide valve body. These insights, that the inventors have been able to identify by means of assiduous work, have formed the basis for the present invention, more precisely to propose a slave piston having smaller mass as well as a pneumatic dampening of the movement of the slave piston just before the moment of impact.

According to a preferred embodiment of the present invention the slave piston comprises a piston driver, which is located in a piston driver volume of said bore, the piston driver of the slave piston interacting with said opening that connects the piston driver volume of the bore and the control pressure channel.

According to a preferred embodiment the slave piston comprises a piston body that is connected to and jointly displaceable with said piston driver, the piston body being configured to displace said first inlet valve body to the active position in which the inlet channel is open.

According to another preferred embodiment the first inlet valve body is constituted by a seat valve body having an inactive position at which the inlet channel is closed, the slave piston being configured to during its movement from the inactive position to the active position ram said first inlet valve body and displace it to an active position at which the inlet channel is open.

According to a preferred embodiment of the present invention, the actuator comprises an electrically controlled pilot valve configured to communicate a control pressure (CP) to and through the opening via said control pressure channel. Thus, the slave piston is indirectly electrically driven by means of said pilot valve.

Further advantages of and features of the invention are evident from the other dependent claims and from the following detailed description of preferred embodiments.

BRIEF DESCRIPTION OF THE DRAWINGS

A more complete understanding of the abovementioned and other features and advantages of the present invention will be evident from the following detailed description of preferred embodiments with reference to the enclosed drawings, in which.

DETAILED DESCRIPTION OF PREFERRED EMBODIMENTS

Figure 1:
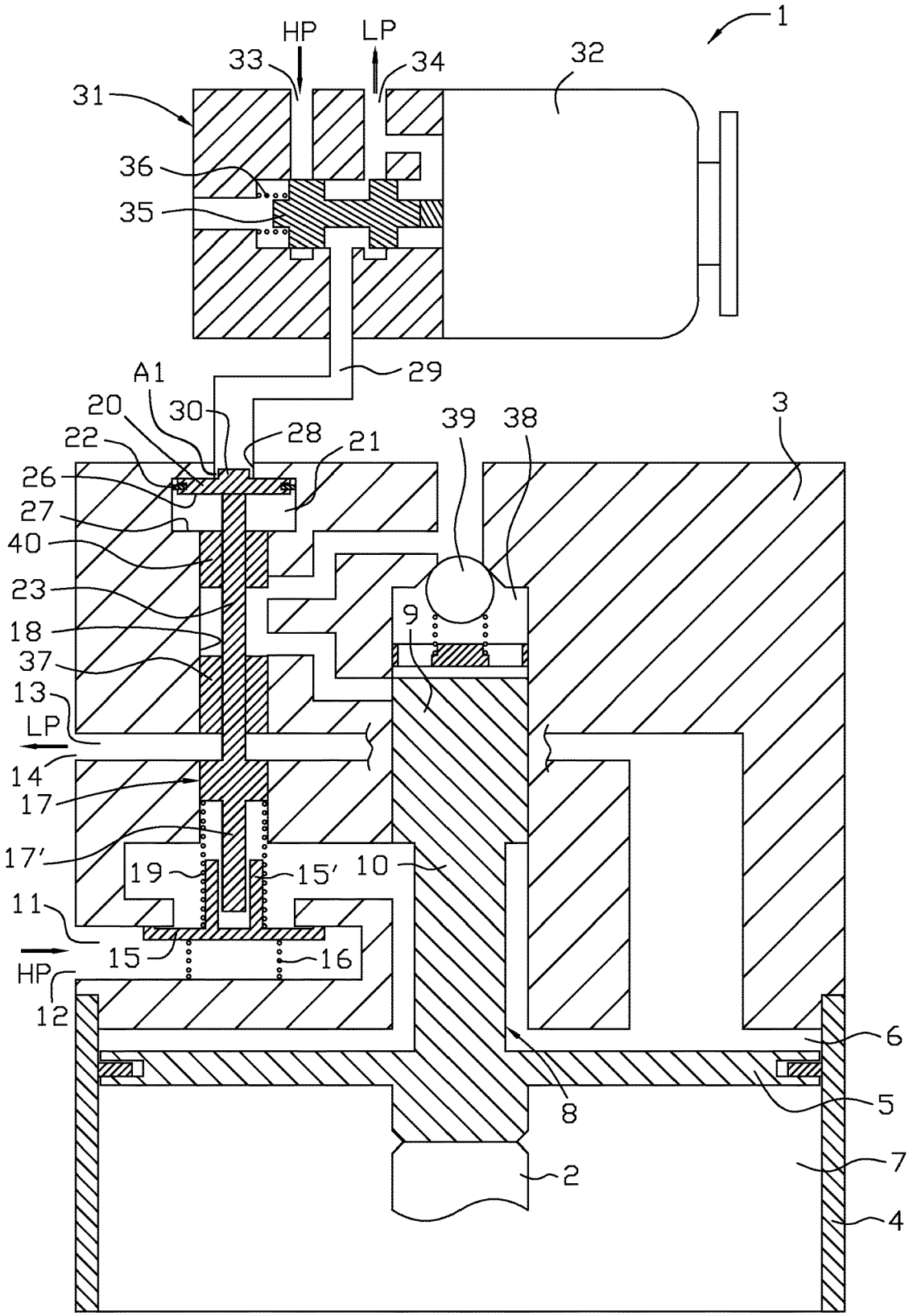
FIG. 1 is a schematic illustration of an inventive actuator according to a first embodiment, where the actuator is in an inactive state.

Reference is initially made to FIG. 1, disclosing a preferred embodiment of the inventive actuator, generally designated 1.

The present invention relates to an actuator 1 for axial displacement of an object, such as an actuator 1 for axial displacement of a gas exchange valve 2 of an internal combustion engine. Herein below the invention will be described in an exemplifying but not to a limiting purpose with reference to an application in which the actuator 1 is used for driving one or more inlet valves or outlet valves 2 in an internal combustion engine.

Figure 3:
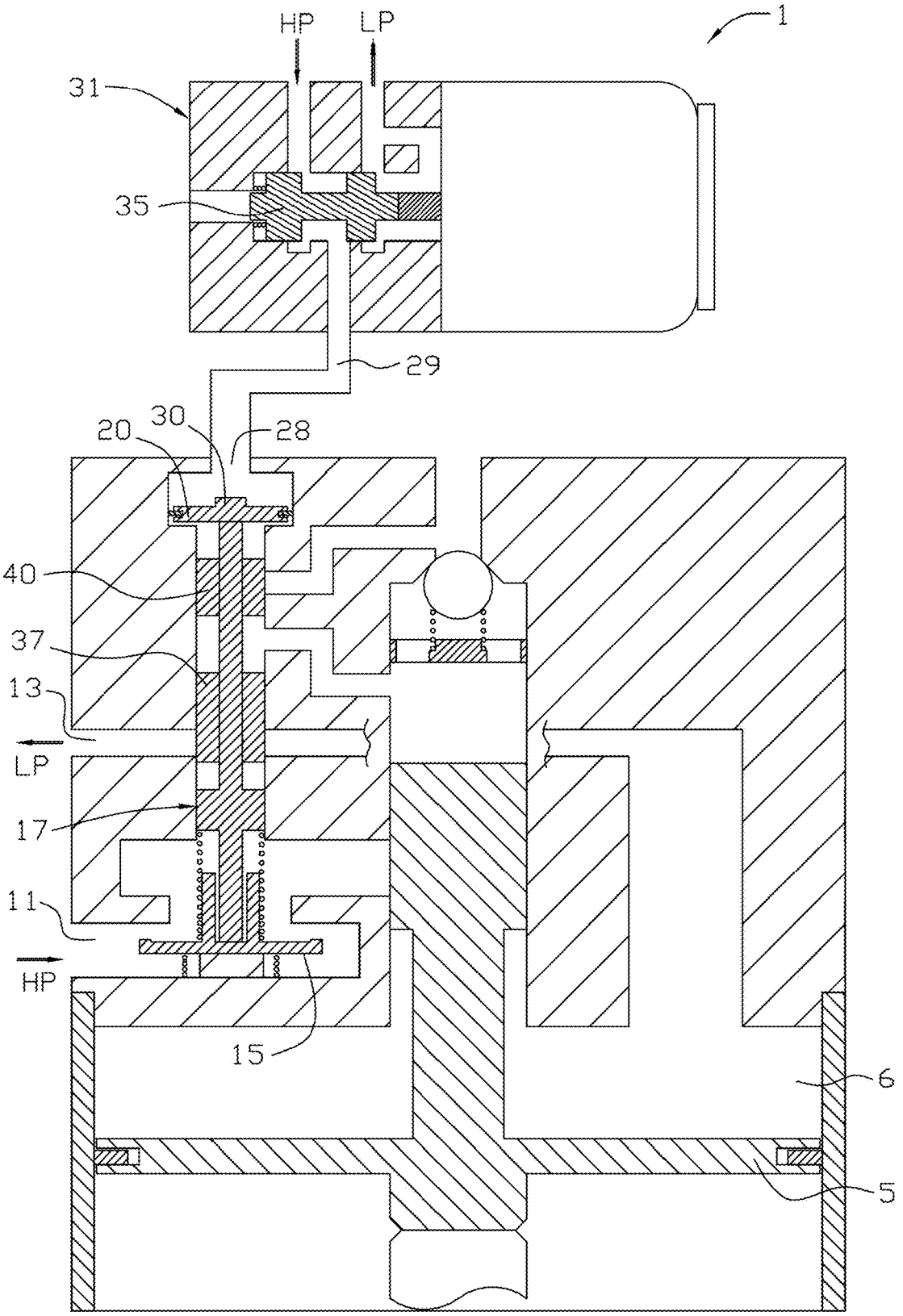
FIG. 3 is a schematic illustration of the actuator according to FIGS. 1 and 2, where the actuator is in its fully activated state.

In the shown embodiment, the actuator 1 comprises an actuator housing 3, a cylinder 4 delimiting a cylinder volume or chamber, an actuator piston disc 5 that is arranged in and that in axial direction is displaceable back and forth in said cylinder volume between an inactive resting position (FIG. 1) and an active position/lower dead centre (FIG. 3). The actuator piston disc 5 separates said cylinder volume in a first upper portion 6 and a second lower portion 7. The valve shaft of the gas exchange valve 2 ends in the second portion 7 of the cylinder volume, and the gas exchange valve 2 is biased in a direction upward by means of a conventional valve spring or gas spring (not shown). The actuator piston disc 5 returns to its inactive position by being biased, preferably by way of spring means, in a direction upwards in the figures. The spring means may be a mechanical spring or gas spring located in the second portion 7 of the cylinder volume. In the event the actuator piston drives an inlet or outlet valve of an internal combustion engine the spring may be constituted by a valve spring that lifts the gas exchange valve to its closed position. However, alternative solutions to realize the biasing are conceivable within the scope of the present invention.

The actuator 1 further comprises an actuator piston rod, generally denoted 8, which is rigidly connected to and axially extending from the actuator piston disc 5, and which together with the actuator piston disc forms an actuator piston. The actuator piston rod 8 eliminates the risk for a skew setting of the actuator piston disc 5. The actuator piston rod 8 has in the shown embodiment a first thicker portion 9, which is located at a distance from the actuator piston disc 5 and is in a tight fit with a bore in the actuator housing 3, and a second thinner portion 10 extending between and connecting the thicker portion 9 and the actuator piston disc 5. In this embodiment, the thicker portion 9 constitutes a second inlet valve body that will be described herein below.

The actuator 1 also comprises a pressure fluid circuit, preferably a pneumatic, configured for a controllable supply of a gas or gas mixture, for example air, to the first portion 6 of the cylinder volume to generate a displacement of the actuator piston disc 5 from the inactive position to the active position, and configured for controllable evacuation of the gas or gas mixture from the first portion 6 of the cylinder volume to generate a return movement of the actuator piston disc 5 from the active position to the inactive position.

The pressure fluid circuit comprises an inlet channel 11 extending between a pressure fluid inlet 12 in the actuator housing 3 and the first portion 6 of the cylinder volume, and an outlet channel 13 extending between the first portion 6 of the cylinder volume and a pressure fluid outlet 14 in the actuator housing 3. Said inlet channel 11 is via the pressure fluid inlet 12 connected to a pressure fluid source (HP), and said outlet channel 13 is via the pressure fluid outlet 14 connected to a pressure fluid sink (LP). In other words the pressure fluid inlet 12 of the actuator 1 is configured to be connected to the pressure fluid source (HP), and the pressure fluid outlet 14 is configured to be connected to the pressure fluid sink (LP). The pressure fluid source may be a compressor that belongs to the internal combustion engine and with or without a belonging tank, or only a pressure tank. The pressure fluid sink may be any point with a lower pressure than the one generated in the pressure fluid source, for example a conduit leading back to the compressor. The pressure fluid circuit is preferably a closed system with a raised return pressure, i.e. the pressure fluid sink (LP) has for example a pressure of 4-6 Bar, and the pressure fluid source has for example a pressure of 15-25 Bar.

The actuator 1 comprises a first inlet valve body 15 arranged in said inlet channel 11 for controlling the flow of pressure fluid in the inlet channel 11 past the position where the first inlet valve body 15 is situated, i.e. arranged to open and close, respectively, the inlet channel 11. Thus, the inlet channel 11 is closed when the first inlet valve body 15 is located in its inactive position and opened when the first inlet valve body 15 is located in its active position. It is preferred that the first inlet valve body 15 is constituted by a seat valve body, thereby a geometrically well defined inactive position for the inlet valve body 15 is obtained as well as the inlet channel 11 being free from leakage past the first inlet valve body 15 when it is located in its inactive position. The inlet valve body 15 is preferably biased by way of a spring 16 in one the inlet channel 11 closing direction.

Figure 2:
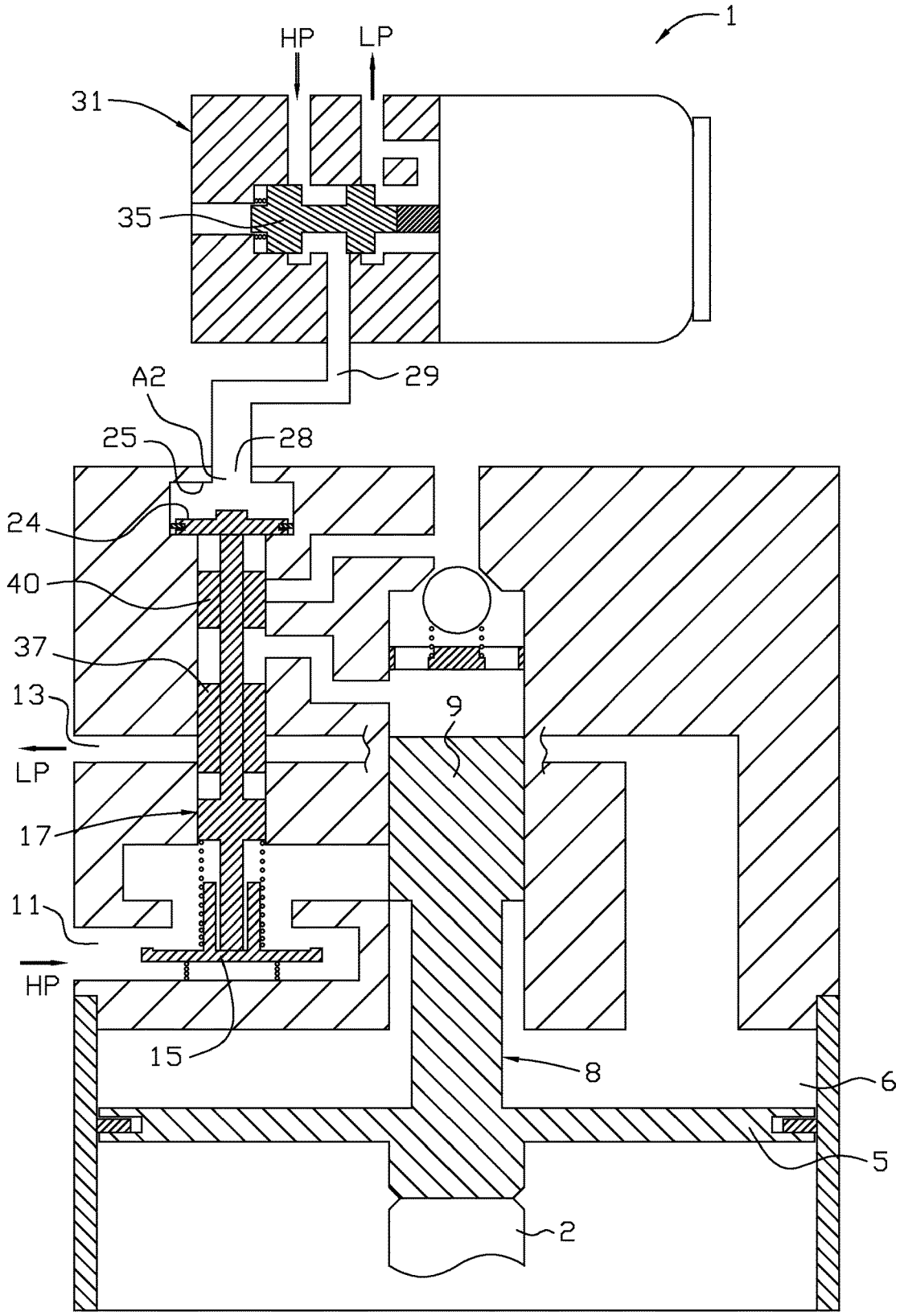
FIG. 2 is a schematic illustration of the actuator according to FIG. 1, where the actuator is activated and the object is in movement.

The actuator comprises a slave piston, generally designated 17, that is displaceable back and forth in a bore 18 in the actuator housing 3 between an inactive position and an active position, the slave piston 17 being configured to during its movement from the inactive position to the active position displace the first inlet valve body to its active position where the inlet channel 11 is open, as disclosed in FIGS. 2 and 3. Preferably the slave piston 17 is configured to during its movement from the inactive position to the active position ram said first inlet valve body 15 and displace it to an active position where the inlet channel 11 is open. The term ram is meant that the slave piston 17 is in movement when it hits the inlet valve body 15 that is standing still and that is thereby put in movement. After the ramming the slave piston 17 drives the inlet valve body 15 to and keeps it in its active position. Directly after the slave piston 17 has struck open/rammed the inlet valve body 15 it is preferred that the inlet valve body 15 obtains a higher velocity than the slave piston 17 and thereby a faster opening of the inlet channel 11 is obtained. The slave piston 17 then hunts down the first inlet valve body 15. In the disclosed embodiment, a spring 19 is located between the slave piston 17 and the first inlet valve body 15, whereupon the inlet valve body 15 contribute to return and keep the slave piston 17 in its inactive position when the inlet valve body 15 closes the inlet channel 11. Thereto, also pressure fluid located in the inlet channel 11 acts to return the slave piston 17 when the inlet valve body 15 closes.

Preferably the end of the slave piston 17 that is configured to drive the first inlet valve body 15 comprises an axially extending pin 17', that is arranged in telescopic relation relative to a sleeve/recess 15' of the first inlet valve body 15. It shall be pointed out that the inverted relationship may occur, i.e. that the slave piston 17 comprises a sleeve or recess and the first inlet valve body 15 comprises a pin. This design entails elimination of the risk of skew setting of the first inlet valve body 15.

The slave piston 17 comprises preferably a piston driver 20, which is located in a piston driver volume 21 of said gore 18. The piston driver 20 is arranged in tight fit with the side walls of the piston driver volume 21, preferably by means of at least one piston ring seal 22. The piston driver 20 is arranged in that end of the slave piston 17 that is opposite the end of the slave piston 17 that is configured to drive/ram the first inlet valve body 15. The slave piston 17 comprises preferably a piston body 23 that is connected to and jointly displaceable with said piston driver 20. It is the piston body 23 of the slave piston 17 that is configured to displace said first inlet valve body 15 to the active position where the inlet channel 11 is open. The piston driver 20 has a greater cross sectional area than the piston body 23 taken across the bore 18. The piston driver 20 and the piston body 23 are preferably concentrically arranged in relation to each other. The piston body 23 and the piston driver 20 may according to a first embodiment be constituted by two parts of one and the same member, and may according to a second embodiment be constituted by a composed member comprising two parts, the latter being preferred from a manufacturing point of view. More preferably the piston driver 20 comprises a recess in which the piston body 23 is inserted, preferably pressed into, in order to obtain as exact concentricity as possible between the piston body 23 and the piston driver 20.

When the slave piston 17 is located in its inactive position, a first (upper) surface 24 of the piston driver 20 abut a first stop surface 25, and according to the embodiment disclosed in FIGS. 1 and 2 a second (lower) surface 26 of the piston driver 20 abut a second stop surface 27 when the slave piston 17 is located in its active position. Thus, the distance between the first stop surface 25 and the second stop surface 27, together with the distance between the first surface 24 and the second surface 26 of the piston driver 20, define the length of stroke of the slave piston 17. In the preferred embodiment disclosed in FIG. 3 the first inlet valve body 15 abut a mechanical stop when the first inlet valve body 15 is located in its active position, the slave piston 17 abutting the first inlet valve body 15 without the second (lower) surface 26 of the piston driver 20 being in contact with the second stop surface 27.

It is essential for the invention that the slave piston 17 interacts with an opening 28 that connect the bore 18 and a control pressure channel 29. The opening 28 has a first flow area (A1) when the slave piston 17 is located in its inactive position and a second flow area (A2) when the slave piston 17 is located in its active position, wherein said second flow area (A2) being greater than said first flow area (A1). In the preferred embodiment the piston driver 20 of the slave piston 17 interacts with the opening 28 that connects the piston driver volume 21 of the bore 18 and the control pressure channel 29. More specifically the control pressure channel 29 is in fluid communication with that portion of the piston driver volume 21 that is delimited by the piston driver 20 and the first stop surface 24.

It is preferred that the opening 28 presents the second flow area (A2) during at least 70% of the length of stroke of the slave piston 17, preferably at least 80%, and most preferably at least 90%. Thereafter the flow area of the opening 28 decrease from the second flow area (A2) to the first flow area (A1) in one step, in a plurality of steps, uniformly continuously, non-uniformly continuously, etc., when the slave piston 17 is displaced in the direction towards its inactive position.

In the disclosed, preferred embodiment the piston driver 20 has at least one projection 30 that is located in said opening 28 when the slave piston 17 is located in its inactive position and that is located at a distance from said opening 28 when the slave piston 17 is located in its active position. The projection 30 may for instance be cylindrical, stepped, conical, etc. Thus, the projection 30 is connected to the slave piston 17 irrespective of the slave piston comprising a piston driver or not.

The actuator comprises in the disclosed embodiment an electrically controlled pilot valve 31, also known as multi-way valve, which is configured to communicate a control pressure (CP) to the slave piston 17 via said control pressure channel 29, more precisely to the piston driver volume 21 via the control pressure channel 29 and the opening 28. By electrically controlled means controlled by way of an electro magnetic device, such as a solenoid 32, by way of a piezo electric device, etc. Thus, the control pressure channel 29 extends from the pilot valve 31 to the end of the slave piston 17 that is opposite the end of the slave piston 17 configured to drive the inlet valve body 15. The pilot valve 31 is configured to take an inactive state (FIG. 1), in which the control pressure channel 29 is in fluid communication with a control fluid outlet 33 of the pilot valve 31, and an active state (FIGS. 2 and 3), in which the control pressure channel 29 is in fluid communication with a control fluid inlet 34. The control fluid inlet 34 of the pilot valve 31 is configured to be connected to a pressure fluid source (HP), and the control fluid outlet 33 of the pilot valve 31 is configured to be connected to a pressure fluid sink (LP).

It shall be pointed out that in all drawings the pilot valve 31 is drawn located outside the actuator housing 3, which is fully conceivable, still it is preferable that the pilot valve 31 as well as the control pressure channel 29 are located fully or partly within the actuator housing 3.

In a preferred embodiment, the pilot valve 31 comprises a pilot valve body arrangement 35, which is displaceable back and forth between an inactive position and an active position, whereby the pilot valve body arrangement 35 is biased by way of a spring 36 in a direction toward its inactive position. The solenoid 32 is configured to displace the pilot valve body arrangement 35 in the direction toward its active position when said solenoid 32 is activated. The activation of the solenoid 32 takes place due to a change of state instruction from a control unit of the engine, i.e. an instruction to open the engine valve 2, that in its turn for instance is initiated based on the position of the crank shaft.

The actuator 1 preferably comprises a second inlet valve body that is arranged in said inlet channel 11, and that in the disclosed embodiment is constituted by the thicker portion 9 of the actuator piston rod 8, i.e. the second inlet valve body 9 is rigidly connected to the actuator piston disc 5 and jointly displaceable with the actuator piston disc 5 between an inactive position and an active position, and is arranged to open and close, respectively, the inlet channel 11. The second inlet valve body is configured to admit fluid flow in the inlet channel 11 when the second inlet valve body is located in its inactive position, see FIG. 1. The second inlet valve body is configured to keep the inlet channel 11 closed when the actuator piston disc 5 is located at least at a predetermined distance from its inactive position, see FIGS. 2 and 3.

According to the disclosed embodiment, the first inlet valve body 15 and the second inlet valve body 9 are arranged in series with each other, and preferably the second inlet valve body 9 is arranged between the first inlet valve body 15 and the first portion 6 of the cylinder volume, since the first inlet valve body 15 provides a better sealing than the second inlet valve body 9, that is constituted by a slide valve body.

The actuator 1 also comprises an outlet valve body 37 arranged in said outlet channel 13 for controlling the flow of pressure fluid in the outlet channel 13 past the position where the outlet valve body 37 is located. Thus, the outlet valve body 37 is displaceable back and forth between an inactive position and an active position, i.e. arranged to open and close, respectively, the outlet channel 13.

In the disclosed embodiment the outlet valve body 37 is connected to and jointly displaceable with the slave piston 17. This entails that the outlet channel 13 may/will be entirely or to great extent closed by the outlet valve body 37 before the inlet channel 11 is opened by the first inlet valve body 15. Thereby draught and unnecessary consumption of pressure fluid are prevented.

According to a non-disclosed embodiment, the outlet valve body 37 is constituted by a slide valve body separated from the slave piston 17. The outlet valve body is biased by way of a spring in the direction towards its inactive position, in which the outlet channel 13 is open. Thereto the pilot valve 31 is configured to communicate said control pressure to the outlet valve body via said control pressure channel 29. Thus, the control pressure channel 29 extends from the pilot valve 31 to the end of the outlet valve body that is opposite the end of the outlet valve bod against which the spring acts. Upon activation of the pilot valve 31, the outlet valve body will entirely or to a great extent close the outlet channel 13 before the slave piston 17 opens the first inlet valve body 15. Thereby draught and unnecessary consumption of pressure fluid are prevented.

According to another non-disclosed embodiment, the outlet valve body 37 is constituted by a seat valve body that preferably is biased by means of a spring in one the outlet channel 13 closing direction. The outlet valve body comprises preferably a guide pin for eliminating the risk of skew setting thereof. As in the first embodiment the pilot valve 31 is configured to communicate said control pressure to the outlet valve body 37 via said control pressure channel 29.

When the outlet valve body 37 is connected to the slave piston 17 no separate springs are needed to bias the outlet valve body 37 towards its inactive position.

The actuator 1 comprises preferably a hydraulic circuit comprising a locking volume 38, a non-return valve 39 and a hydraulic valve, the actuator piston rod 8 being arranged to be displaced in an axial direction relative to said locking volume 38 in connection with axial displacement of the actuator piston disc 5 in the cylinder volume. Liquid (oil) is allowed to flow into the liquid filled locking volume 38 via the non-return valve 39 and out from the locking volume 38 via the hydraulic valve. The hydraulic valve comprises a hydraulic valve body 40, which is displaceable back and forth between an inactive position, in which the locking volume 38 is open, and an active position, in which the locking volume 38 is closed. In the disclosed embodiment the hydraulic valve body 40 is connected to and jointly displaceable with the slave piston 17. When the actuator piston is displaced from the inactive position (FIG. 1) to the active position (FIG. 3) the actuator piston rod 8 leaves space for inflow of liquid into the locking volume 38 and the hydraulic valve is closed, and when the actuator rod is displaced from the active position to the inactive position the hydraulic valve must first be opened whereupon the liquid is pressed out from the locking volume 38.

According to a non-disclosed embodiment the hydraulic valve body 40 is constituted by a slide valve body that is separated from the slave piston 17. The hydraulic valve body 40 is then biased by means of a spring in the direction towards its inactive position. Thereto the pilot valve 31 is configured to communicate said control pressure to the hydraulic valve body via said control pressure channel 29. Thus, the control pressure channel 29 extends from the pilot valve 31 to the end of the hydraulic valve body that is opposite the end of the hydraulic valve body against which the spring acts. When the hydraulic valve body 40 is connected to the slave piston 17 no separate springs are needed to bias the hydraulic valve body 40 towards its inactive position.

In another non-disclosed embodiment the hydraulic valve body and the outlet valve body are connected to and jointly displaceable with each other, as well as separated from the slave piston 17.

It shall be pointed out that the outlet valve body and the hydraulic valve body, respectively, have the same functions irrespective of location.

Herein below the function of the actuator 1 according to the disclosed embodiment will be described.

In the starting position, the actuator 1 is in its inactive state (see FIG. 1), i.e. the pilot valve 31 is in inactive state and the solenoid 32 is inactivated, and low fluid pressure has effect in the control pressure channel 29. The first inlet valve body 15 is in closed position, the actuator piston disc 5 is in the inactive position/upper dead centre and the second inlet valve body 9 is in open position, the outlet valve body 37 is in the disclosed embodiment open, and the hydraulic valve body 40 is open. (See FIG. 1) Thus, the actuator consumes neither power nor pressure fluid in the inactive state.

When a change of state signal/instruction is given by the control unit that the actuator 1 shall perform a displacement of the object/engine valve, the solenoid 32 is activated and the pilot valve 31 change to active state (see FIG. 2). This leads to a high fluid pressure having effect in the control pressure channel 29, whereupon the slave piston 17, the outlet valve body 37 and the hydraulic valve body 40 are displaced towards and secured in their active positions. When the slave piston 17 has gained speed the slave piston 17 ram the inlet valve body 15, which quickly is displaced towards its active position and immediately opens the inlet channel 11.

When the inlet channel 11 is open the pressure fluid starts to flow into the first portion 6 of the cylinder volume from the pressure fluid source (HP) via the inlet channel 11, and pressure fluid having high pressure acts against the upper side of the actuator piston disc 5 and displaces the actuator piston in a downward direction. Liquid is sucked into the locking volume 38 past the non-return valve 39 when the actuator piston rod 8 is displaced downwards. The outlet valve body 37 is kept closed. When the actuator piston disc 5 has been displaced a predetermined distance the second inlet valve 9 cuts off the pressure fluid flow in the inlet channel 11, i.e. prevents a continued inflow of pressure fluid from the pressure fluid source (HP) to the first portion 6 of the cylinder volume, see FIG. 2. When the supply of pressure fluid from the pressure fluid source (HP) is cut off, the actuator piston disc 5 continues its displacement a distance during the expansion of the pressure fluid in the first portion 6 of the cylinder volume, see FIG. 3.

When actuator piston disc 5 has reached its active position/lower dead centre, the actuator piston disc 5 is locked (kept in place) as a result of the liquid in the locking volume 38 not being allowed to evacuate.

When the object/engine valve 2 shall start its return movement the solenoid 32 is deactivated, whereupon the pilot valve 31 takes its inactive state, and low fluid pressure has effect in the control pressure channel 29. The slave piston 17 is now allowed to be displaced to its inactive position, whereupon the first inlet valve body 15 closes the inlet channel 11 and contributes to return the slave piston 17, the hydraulic valve body 40 is opened to allow evacuation of liquid from the locking volume 38, the outlet valve body 37 opens the outlet channel 13, and the actuator piston disc 5 can be displaced upwards to the inactive position by means of the spring member. The movement of the slave piston 17 is damped just before it takes its inactive position, thanks to the interaction between the slave piston 17 and the opening 28.

FEASIBLE MODIFICATIONS OF THE INVENTION

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equipment may be modified in all kinds of ways within the scope of the appended claims.

It shall also be pointed out that all information about/concerning terms such as above, below, upper, lower, etc., shall be understood/read with the equipment oriented in accordance with the figures, having the drawings oriented in such a way that the indexing can be read in a correct way. Thus, similar terms indicate only mutual relationships in the shown embodiments, which relationships can be changed if the equipment according to the invention is provided with another construction/design.

It shall be pointed out that even if it is not explicitly stated that a feature from a specific embodiment can be combined with the features in another embodiment, this shall be considered obvious when possible.

The invention claimed is:

1. An actuator for axial displacement of an object, the actuator comprising:

an actuator piston disc (5);

a cylinder volume, wherein the actuator piston disc (5) separates said cylinder volume into a first portion (6) and a second portion (7), and the actuator piston disc (5) is displaced back and forth in an axial direction in said cylinder volume between a first inactive position and a first active position;

an inlet channel (11) extending between a pressure fluid inlet (12) and the first portion (6) of the cylinder volume;

a first inlet valve body (15) arranged in said inlet channel (11);

an outlet channel (13) extending between the first portion (6) of the cylinder volume and a pressure fluid outlet (14);

an outlet valve body (37) arranged in said outlet channel (13); and a slave piston (17) that is displaced back and forth in a bore (18) between a second inactive position and a second active position, the slave piston (17) being configured to, during a displacement of the slave piston (17) from the second inactive position to the second active position, displace said first inlet valve body (15) to a third active position at which the inlet channel (11) is open, and the slave piston (17) comprising a piston driver (20) that is located in a piston driver volume (21) of said bore (18) and having at least one projection configured to interact with an opening (28) that connects the piston driver volume (21) of the bore (18) and a control pressure channel (29) configured to be connected to an electrically controlled pilot valve (31), the projection (30) being located in the opening (28) and the opening (28) having a first flow area (A1) through which a flow is permitted to pass through the opening (28) when the slave piston (17) is located in the second inactive position, and said projection (30) being located at a distance from the opening (28) and the opening (28) having a second flow area (A2) through which the flow is permitted to pass through the opening (28) when the slave piston (17) is located in the second active position, said second flow area (A2) being greater than said first flow area (A1) so that a movement of the slave piston (17) is pneumatically damped just before the slave piston (17) takes the second inactive position.

2. The actuator according to claim 1, wherein the slave piston (17) comprises a piston body (23) that is connected to and jointly displaced with said piston driver (20), the piston body (23) being configured to displace said first inlet valve body (15) to the third active position at which the inlet channel (11) is open.

3. The actuator according to claim 2, wherein the piston driver (20) has a greater cross sectional area than the piston body (23), taken across the bore (18).

4. The actuator according to claim 1, wherein the first inlet valve body (15) is constituted by a seat valve body having a third inactive position at which the inlet channel (11) is closed, the slave piston (17) being configured to, during the displacement from the second inactive position to the second active position, ram said first inlet valve body (15) and displace said first inlet valve body (15) into the third active position at which the inlet channel (11) is open.

5. The actuator according to claim 1, further comprising:

a second inlet valve body (9) arranged in said inlet channel (11), the second inlet valve body (9) being rigidly connected to the actuator piston disc (5) and jointly displaced with the actuator piston disc (5) between a fourth inactive position and a fourth active position.

6. The actuator according to claim 5, wherein an actuator piston rod (8) is rigidly connected to and axially extending from the actuator piston disc (5), and together with the actuator piston disc (5) form an actuator piston, said second inlet valve body (9) constituting part of said actuator piston rod (8).

7. The actuator according to claim 6, further comprising:

a hydraulic circuit, which comprises a locking volume (38), a non-return valve (39) and a hydraulic valve, wherein the actuator piston rod (8) is arranged to be displaced in the axial direction relative to said locking volume (38) in connection with axial displacement of the actuator piston disc (5) in the cylinder volume.

8. The actuator according to claim 7, wherein the hydraulic valve comprises a hydraulic valve body (40) which is displaced back and forth between a fifth inactive position, in which the locking volume (38) is open, and a fifth active position, in which the locking volume (38) is closed.

9. The actuator according to claim 8, wherein the hydraulic valve body (40) is connected to and jointly displaced with the slave piston (17).

10. The actuator according to claim 5, wherein the second inlet valve body (9) is configured to admit fluid flow in the inlet channel (11) when the second inlet valve body (9) is located in the fourth inactive position, and is configured to prevent fluid flow in the inlet channel (11) when the second inlet valve body (9) is located at least a predetermined distance from the fourth inactive position.

11. The actuator according to claim 1, wherein the pressure fluid inlet (12) is configured to be connected to a pressure fluid source (HP), and wherein the pressure fluid outlet (14) is configured to be connected to a pressure fluid sink (LP).

12. The actuator according to claim 1, wherein in an inactive state of said electrically controlled pilot valve (31), the control pressure channel (29) is in fluid communication with a control fluid outlet (33) of said electrically controlled pilot valve (31), and in an active state of said electrically controlled pilot valve (31), the control pressure channel (29) is in fluid communication with a control fluid inlet (34).

13. The actuator according to claim 12, wherein the control fluid inlet (34) of the electrically controlled pilot valve (31) is configured to be connected to a pressure fluid source (HP), and wherein the pressure fluid outlet (33) of the electrically controlled pilot valve (31) is configured to be connected to a pressure fluid sink (LP).

14. The actuator according to claim 1, wherein the outlet valve body (37) is connected to and jointly displaced with the slave piston (17).

* * * * *